US009657756B2

(12) United States Patent
Bostiga et al.

(10) Patent No.: US 9,657,756 B2
(45) Date of Patent: May 23, 2017

(54) ACTUATOR SYSTEM

(71) Applicant: Hamilton Sundstrand Corporation, Charlotte, NC (US)

(72) Inventors: Richard H. Bostiga, Ellington, CT (US); Charles E. Reuter, Granby, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 302 days.

(21) Appl. No.: 14/460,055

(22) Filed: Aug. 14, 2014

(65) Prior Publication Data

US 2016/0047478 A1 Feb. 18, 2016

(51) Int. Cl.
*F15B 18/00* (2006.01)
*F15B 20/00* (2006.01)

(52) U.S. Cl.
CPC ..... *F15B 18/00* (2013.01); *F15B 20/005* (2013.01); *F15B 2211/30565* (2013.01)

(58) Field of Classification Search
CPC ..... F15B 13/042; F15B 18/00; F15B 20/005; F15B 2211/30565
See application file for complete search history.

(56) References Cited

U.S. PATENT DOCUMENTS 5,857,488 A * 1/1999 Kobelt ..... B63H 25/22 114/150
6,382,076 B1 5/2002 Garcia
6,637,199 B2 * 10/2003 Spickard ..... F02C 9/285 60/403
8,020,379 B2 * 9/2011 Kakino ..... F15B 18/00 244/78.1
2003/0140625 A1 7/2003 Spickard
2009/0165457 A1 7/2009 Kaino et al.

OTHER PUBLICATIONS

Search Report under Section 17(5) dated Dec. 4, 2015 in UK Application No. GB1510061.3.

* cited by examiner

*Primary Examiner* — Thomas E Lazo
(74) *Attorney, Agent, or Firm* — Snell & Wilmer, L.L.P.

(57) ABSTRACT

An actuator system having various features is disclosed. An actuator system may have a first and a second electrohydraulic servo valve. A control selector may connect one of the electrohydraulic servo valves to a cylinder and may isolate the other electrohydraulic servo valve to ameliorate leakage in response to a switching solenoid valve operating. In this manner, one electrohydraulic servo valve may be connected to a cylinder to operate the cylinder, and the other electrohydraulic servo valve may be isolated from the cylinder, for example, to provide a standby electrohydraulic servo valve.

13 Claims, 8 Drawing Sheets

ACTUATOR SYSTEM

STATEMENT REGARDING GOVERNMENT RIGHTS

These inventions were made with government support under FA8650-09-D-2923-AETD awarded by the United States Air Force. The government has certain rights in these inventions.

FIELD

The present invention relates to the field of hydraulic actuator systems, and more specifically, hydraulic actuator systems having dual electrohydraulic servovalves.

BACKGROUND

In hydraulic actuation applications having dual electrohydraulic servovalves, the leakage through the servo valves and the valves that switch between them is often a large percentage of the total flow that a hydraulic pump must provide. This leakage may reduce system actuation force, may increase response times, and may require pumps to be sized to account for a significant amount of the total flow being lost to leakage.

SUMMARY OF THE INVENTION

In accordance with various aspects of the present invention, an integrated actuator system is disclosed. The actuator system may include a first electrohydraulic servo valve having a four-port valve including a first fluid supply port, a first fluid return port, a first extension port, and a first retraction port. One of the first retraction port and the first extension port may be connectable to the first fluid supply port in response to a first electrohydraulic servo valve control signal, and an other of the first retraction port and the first extension port may be connectable to the first fluid return port in response to the first electrohydraulic servo valve control signal.

The actuator system may include a second electrohydraulic servo valve having a four-port valve including a second fluid supply port, a second fluid return port, a second extension port, and a second retraction port. One of the second retraction port and the second extension port may be connectable to the second fluid supply port in response to a second electrohydraulic servo valve control signal, and the other of the second retraction port and the second extension port may be connectable to the second fluid return port in response to the second electrohydraulic servo valve control signal. The first fluid supply port and the second fluid supply port may be in fluid communication with a hydraulic supply.

The actuator system may also include a switching solenoid valve having a return input, a fluid supply input, a selection control output, and a solenoid plunger. The solenoid plunger may connect one of the return input and the fluid supply input to the selection control output in response to a switching solenoid valve control signal. Finally, the actuator system may have a control selector whereby one of the first electrical hydraulic servo valve and the second electrohydraulic servo valve may be connected to a cylinder in response to the switching solenoid valve connecting one of the return input and the fluid supply input to the selection control output.

A method of actuator system control is disclosed. The method of actuator system control may include receiving, by a switching solenoid valve, a switching solenoid valve control signal and operating the switching solenoid valve to select a selected electrohydraulic servo valve in response to the switching solenoid valve control signal.

The selected electrohydraulic servo valve includes one of a first electrohydraulic servo valve, and a second electrohydraulic servo valve. The method may further include providing, by the switching solenoid valve, selection control information to a control selector, operating the control selector in response to the selection control information, and connecting the selected electrohydraulic servo valve to a cylinder in response to the operating the control selector.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

For the sake of brevity, conventional techniques for manufacturing and construction may not be described in detail herein. Furthermore, the connecting lines shown in various figures contained herein are intended to represent exemplary functional relationships and/or physical couplings between various elements. It should be noted that many alternative or additional functional relationships or physical connections may be present in a practical method of construction. For example, in various embodiments, isolation valves may reduce leakage, whereas in further embodiments, seals may reduce leakage, and in still further embodiments, a combination of valves and seals and/or other elements may reduce leakage.

Embodiments with Isolation Valve

Figure 1:
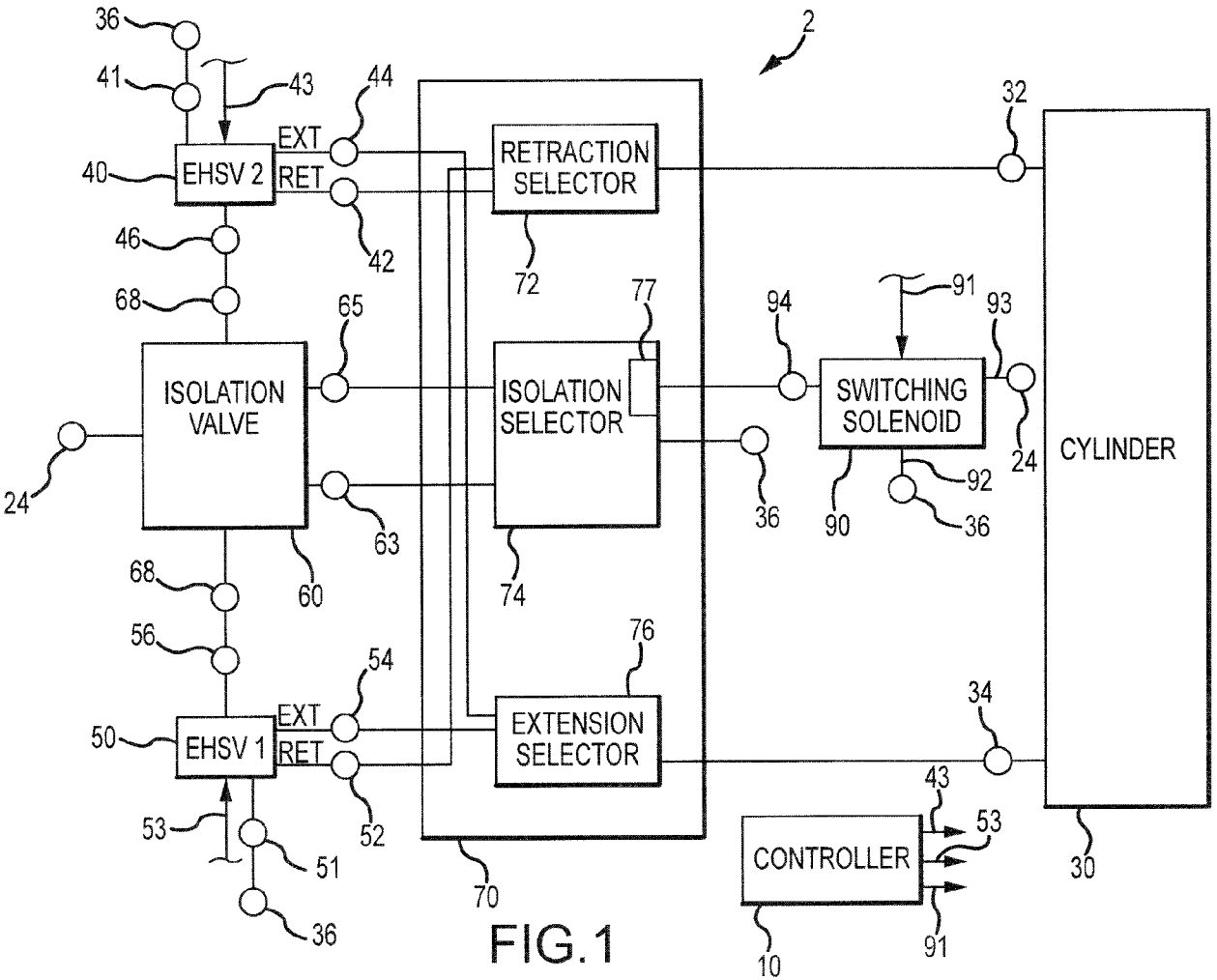
FIG. 1 illustrates a block diagram of an example actuator system having an isolation valve, in accordance with various embodiments.
Figure 3:
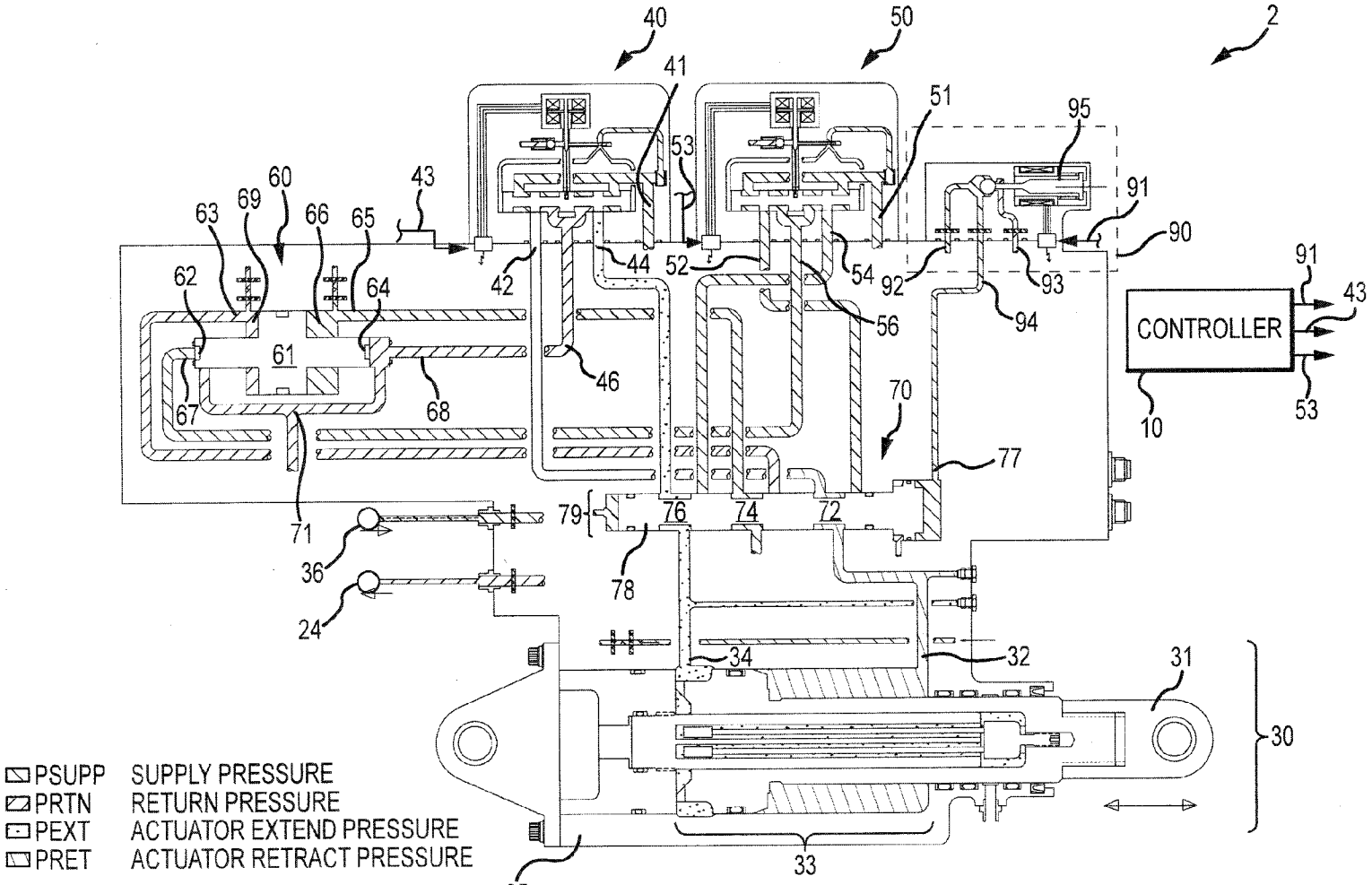
FIG. 3 illustrates an example actuator system having an isolation valve wherein the second of the dual electrohydraulic servovalves is in control, in accordance with various embodiments.
Figure 4:
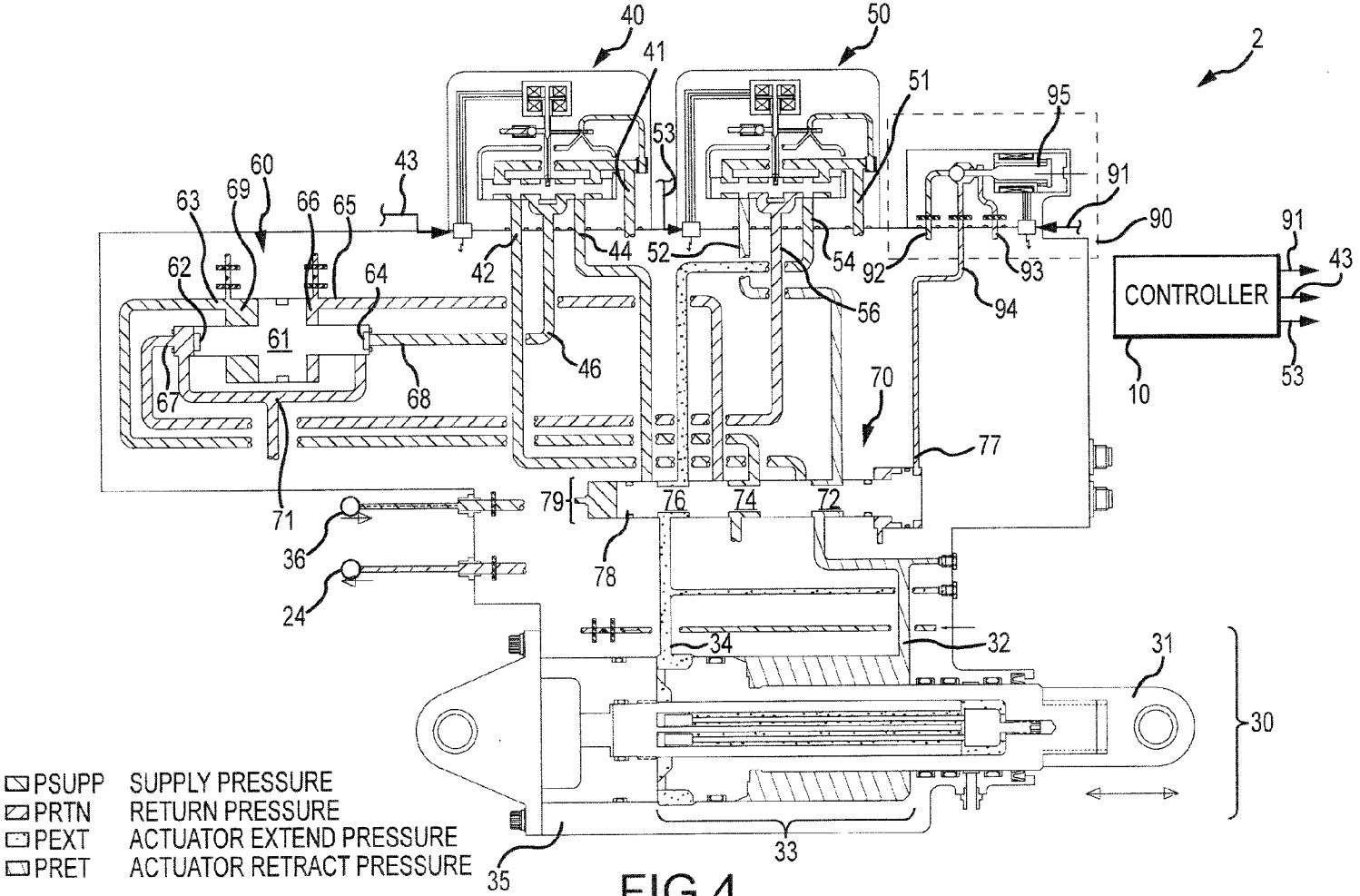
FIG. 4 illustrates an example actuator system having an isolation valve wherein the first of the dual electrohydraulic servovalves is in control, in accordance with various embodiments.

In various embodiments, an actuator system 2 is provided. With reference to FIGS. 1, 3, and 4, an actuator system 2 may comprise a first electrohydraulic servo valve 50 ("EHSV1"), a second electrohydraulic servo valve 40 ("EHSV2"), an isolation valve 60, a control selector 70, and a switching solenoid valve 90. The actuator system 2 may direct the flow of hydraulic fluid to a cylinder 30. For example, the actuator system 2 may direct the cylinder 30 to extend and/or to retract in response to the flow of hydraulic fluid. In various embodiments, the actuator system 2 provides for redundant control of the cylinder 30. For example, the first electrohydraulic servo valve 50 and the second electrohydraulic servo valve 40 may redundantly control the cylinder 30 so that in the event that one electrohydraulic servo valve fails, the other may provide control.

The first electrohydraulic servo valve 50 may comprise a fluid valve whereby the flow of hydraulic fluid may be directed. For example, EHSV1 50 may comprise a four-port valve. EHSV1 may connect various ports in response to an EHSV1 control signal 53. The ESHV1 may comprise a first fluid supply port 51, a first fluid return port 56, a first extension port 54, and a first retraction port 52. With particular reference to FIGS. 3 and 4, the EHSV1 may alternately connect the first extension port 54 in fluidic communication with the first fluid return port 56 and/or connect the first retraction port 52 in fluidic communication with the first fluid return port 56 in response to the EHSV1 control signal 53. In response to the first fluid return port 56 being connected to the first extension port 54, the first retraction port 52 may be connected to the first fluid supply port 51, which is in fluid communication with the aircraft hydraulic supply 36. Similarly, in response to the first fluid return port 56 being connected to the first retraction port 52, the first extension port 54 may be connected to the first fluid supply port 51. The first fluid supply port 51 is in fluid communication with the aircraft hydraulic supply 36. Thus, high pressure fluid may transmit from the aircraft hydraulic supply 36 to the port that is isolated from the first fluid return port 56 and ultimately to the extension input 34 or retraction input 32 of cylinder 30 while the corresponding input of cylinder 30 may be connected to the first fluid return port 56 whereby fluid from the cylinder 30 may be sinked (for example, via a return to the aircraft hydraulic supply). Thus, the EHSV1 may control whether a cylinder 30 is extended or retracted.

Similarly, the second electrohydraulic servo valve 40 may comprise a fluid valve whereby the flow of hydraulic fluid may be directed. For example, EHSV2 40 may comprise a four-port valve. EHSV2 40 may connect various ports in response to an EHSV2 control signal 43. The ESHV2 may comprise a second fluid supply port 41, a second fluid return port 46, a second extension port 44, and a second retraction port 42. With particular reference to FIGS. 3 and 4, the EHSV2 40 may alternately connect the second extension port 44 in fluidic communication with the second fluid return port 46 and/or connect the second retraction port 42 in fluidic communication with the second fluid return port 46 in response to the EHSV2 control signal 43. In response to the second fluid return port 46 being connected to the second extension port 44, the second retraction port 42 may be connected to the first fluid supply port 51, which is in fluid communication with the aircraft hydraulic supply 36. Similarly, in response to the second fluid return port 46 being connected to the second retraction port 42, the second extension port 44 may be connected to the second fluid supply port 41. The second fluid supply port 41 is in fluid communication with the aircraft hydraulic supply 36. Thus, high pressure fluid may transmit from the aircraft hydraulic supply 36 to the port that is isolated from the second fluid return port 46 and ultimately to the extension input 34 or retraction input 32 of cylinder 30 while the corresponding input of cylinder 30 may be connected to the second fluid return port 46 whereby fluid from the cylinder 30 may be sinked (for example, via a return to the aircraft hydraulic supply). Thus, the EHSV2 may control whether a cylinder 30 is extended or retracted.

The isolation valve 60 may be disposed in fluidic communication with both EHSV1 50 and EHSV2 40. The isolation valve 60 may operate to fluidically isolate EHSV1 when EHSV2 is controlling the cylinder 30 and to fluidically isolate EHSV2 when EHSV1 is controlling the cylinder 30. In this manner, leakage of hydraulic fluid through the valve not controlling the cylinder 30 may be ameliorated. As a result, pressure loss and/or bypass hydraulic fluid flow (through the unused valve) may be reduced. The isolation valve 60 may comprise an isolation valve fluid return port 71, an EHSV2-Active/EHSV1-Sealed valve channel 68, and an EHSV1-Active/EHSV2-Sealed valve channel 67. The isolation valve 60 may further comprise an EHSV1-Active/EHSV2-Sealed Control Port 63 and an EHSV2-Active/EHSV1-Sealed Control Port 65. The isolation valve 60 may alternatively connect the isolation valve fluid return port 71 in fluidic communication with the EHSV2-Active/EHSV1-Sealed valve channel 68 and/or connect the isolation valve fluid return port 71 in fluid communication with the EHSV1-Active/EHSV2-Sealed valve channel 67. For example, the isolation valve 60 may connect isolation valve fluid return port 71 in fluid communication with the EHSV1-Active/EHSV2-Sealed valve channel 67 in response to a higher pressure being presented at the EHSV1-Active/EHSV2-Sealed control port 63 than at the EHSV2-Active/EHSV1-Sealed control port 65. Similarly, the isolation valve 60 may connect isolation valve fluid return port 71 in fluid communication with the EHSV2-Active/EHSV1-Sealed valve channel 68 in response to a higher pressure being presented at the EHSV2-Active/EHSV1-Sealed control port 65 than at the EHSV1-Active/EHSV2-Sealed control port 63. In various embodiments, higher pressure being presented at a control port means that the other control port is permitted to bleed down to a lower pressure, for example, that present at isolation valve fluid return port 71.

The control selector 70 may be disposed in fluidic communication with EHSV2 40, the isolation valve 60, and EHSV1 50. The control selector 70 may also be disposed in fluidic communication with a cylinder 30. The control selector 70 may provide instructions to the isolation valve 60, directing the isolation valve 60 as to which EHSV to isolate. For example, the control selector 70 may control whether a higher pressure is presented at the EHSV2-Active/EHSV1-Sealed control port 65 or at the EHSV1-Active/EHSV2-Sealed control port 63, thus controlling the isolation valve 60 (see discussion of isolation selector 74 herein). The control selector 70 may further control which ESHV to connect with cylinder 30 and which ESHV to isolate from the cylinder 30. In this manner, the control selector 70 may control the flow of hydraulic fluid to isolation valve 60 and may control which ESHV is fluidly connected to the cylinder 30.

The switching solenoid valve 90 may provide the input information to operate the control selector 70 whereby the operative EHSV is selected and the isolated ESHV is selected. The switching solenoid valve 90 may receive a switching solenoid valve control signal 91. A solenoid plunger 95 may operate in response to the switching solenoid valve control signal 91 and may connect various ports in response to the switching solenoid valve control signal 91. The switching solenoid valve 90 may comprise a return input 93, a fluid supply input 92 and a selection control output 94. The switching solenoid valve 90 may alternatively connect the return input 93 with the selection control output 94 and/or connect the fluid supply input 92 with the selection control output 94. Thus, the switching solenoid valve 90 may control the control selector 70 by connecting the selection control output 94 with a relatively high hydraulic pressure (via the fluid supply input 92 connected to aircraft hydraulic supply 36) or with a relatively low hydraulic pressure (via the return input 93 connected to aircraft hydraulic sink 24). The fluid supply input 92 provides a relatively high hydraulic pressure because the fluid supply input 92 is connected, via a channel, in fluidic communication with an aircraft hydraulic supply 36. The return input 93 provides a relatively low hydraulic pressure because the return input 93 is connected, via a channel, in fluidic communication with an aircraft hydraulic sink 24.

The cylinder 30 may comprise a main body 35 and an actuator piston rod 31. The main body 35 may comprise an actuator piston cavity 33. The actuator piston rod 31 may be disposed partially within the actuator piston cavity 33 and may translate axially into and out from the actuator piston cavity 33. The cylinder 30 may also comprise a retraction input 32 and an extension input 34. The actuator piston rod 31 may translate axially out from the actuator piston cavity 33 in response to hydraulic fluid flowing into the extension input 34 and out from the retraction input 32. Similarly, the actuator piston rod 31 may translate axially into the actuator piston cavity 33 in response to hydraulic fluid flowing out of the extension input 34 and into the retraction input 32. In this manner, the actuator piston rod 31 of the cylinder 30 may be extended and/or retracted.

The isolation valve 60 may further comprise a piston 61, a first cavity portion 69 and a second cavity portion 66. The piston 61 may comprise a first face seal 62 and a second face seal 64. As isolation valve 60 operates, the piston 61 may move within the first cavity portion 69 and the second cavity portion 66, thus alternately occupying the first cavity portion 69 and second cavity portion 66 depending on which ESHV is desired to be fluidically isolated by the isolation valve 60. Moreover, the piston 61 may comprise a first face seal 62 and a second face seal 64. These face seals may improve the fluidic isolation provided by the isolation valve 60 by reducing fluid leakage around the piston 61.

For example, with reference to FIG. 3, the piston 61 may be translated to occupy the first cavity portion 69. In this arrangement, the first face seal 62 presses against a channel in fluid communication with the first fluid return port 56 of the EHSV1 50. In this manner, the first fluid return port 56 of the EHSV1 50 is fluidically isolated. Thus, fluid may be prevented from leaking through the EHSV1 50 while EHSV2 40 is connected to the cylinder 30. In this arrangement, the second face seal 64 is drawn away from a channel in fluid communication with the second fluid return port 46 of the EHSV2 40. Thus, a conduit is opened for fluid to flow between the second fluid return port 46 of the EHSV2 40 and the isolation valve fluid return port 71 of the isolation valve 60, via EHSV2-Active/EHSV1-Sealed valve channel 68.

For example, with reference to FIG. 4, the piston 61 may be translated to occupy the second cavity portion 66. In this arrangement, the second face seal 64 presses against a channel in fluid communication with the second fluid return port 46 of the EHSV2 40. In this manner, the second fluid return port 46 of the EHSV2 40 is fluidically isolated. Thus, fluid may be prevented from leaking through the EHSV2 40 while EHSV1 50 is connected to the cylinder 30. In this arrangement, the first face seal 62 is drawn away from a channel in fluid communication with the first fluid return port 56 of the EHSV1 50. Thus, a conduit is opened for fluid to flow between the first fluid return port 56 of the EHSV1 50 and the isolation valve fluid return port 71 of the isolation valve 60, via EHSV1-Active/EHSV2-Sealed valve channel 67.

With reference to FIGS. 1, 3, and 4, the control selector 70 may further comprise piston 78 and a cavity 79. The piston 78 may travel within the cavity 79 in response to a selection control input 77. The control selector 70 may receive selection control information from a selection control output 94 of a switching solenoid valve 90. The selection control information may be received via a selection control input 77. In various embodiments, the selection control information comprises a hydraulic pressure, for example, a relatively high hydraulic pressure provided via fluid supply input 92 connected to aircraft hydraulic supply 36 and/or a relatively low hydraulic pressure provided by return input 93 connected to aircraft hydraulic sink 24. In response to the selection control information, the piston 78 travels from side to side within the cavity 79, for instance toward the selection control input 77 and away from the selection control input 77.

The piston 78 may comprise a retraction selector 72, an extension selector 76, and an isolation selector 74. In response to the piston 78 traveling within the cavity 79, the retraction selector 72, the extension selector 76, and the isolation selector 74 travel within the cavity as well. In various embodiments, the retraction selector 72 comprises a circumferential land disposed about the piston 78. Similarly, the extension selector 76 may comprise a circumferential land disposed about the piston 78 and the isolation selector 74 may comprise a circumferential land disposed about the piston 78. As the piston 78 travels from side to side within the cavity 79, for instance toward the selection control input 77 and away from the selection control input 77, the extension selector 76 alternately connects the second extension port 44 of the EHSV2 40 and the first extension port 54 of the EHSV1 50 in fluidic communication with the extension input 34 of the cylinder 30. Similarly, as the piston 78 travels from side to side within the cavity 79, for instance toward the selection control input 77 and away from the selection control input 77, the retraction selector 72 alternately connects the second retraction port 42 of the EHSV2 40 and the first retraction port 52 of the EHSV1 50 in fluidic communication with the retraction input 32 of the cylinder 30. Similarly, as the piston 78 travels from side to side within the cavity 79, for instance toward the selection control input 77 and away from the selection control input 77, the isolation selector 74 alternately connects the EHSV1-Active/EHSV2-Sealed Control Port 65 and the EHSV2-Active/EHSV1-Sealed Control Port 63 of the isolation valve 60 in fluid communication with the aircraft hydraulic supply 36. In this manner, depending on the position of the isolation selector 74, the piston 61 of the isolation valve 60 travels to alternately activate or seal the EHSVs in response to the position of the isolation selector 74. Similarly, the EHSVs are alternately connected to and isolated from the extension input 34 and retraction input 32 of the cylinder 30. In this manner, the control selector 70 operates in response to the switching solenoid valve 90 in order to determine the active EHSV and connect it to the cylinder 30, and to isolate the inactive EHSV from the cylinder 30.

A controller 10 may comprise a processor and a tangible, non-transitory memory. The controller 10 may provide various outputs to control various aspects of the actuator system 2. More specifically, the controller 10 may regulate the passage of fluid through the actuator system 2. For example, the controller 10 may control the actuator system 2 in response to a determination of an action. The controller 10 may control the actuator system 2 by providing a switching solenoid valve control signal 91 to a switching solenoid valve 90, an EHSV2 control signal 43 to the EHSV2 40, and an ESHV1 control signal 53 to the EHSV1 50. In various embodiments, the EHSV2 control signal 43 comprises an indication of whether to extend or retract the cylinder 30. Similarly, the EHSV1 control signal 53 comprises an indication of whether to extend or retract the cylinder 30. Moreover, the switching solenoid valve control signal 91 comprises an indication of whether to select EHSV1 50 to control the cylinder 30, or to select EHSV2 40 to control the cylinder 30. Moreover, the controller 10 may comprise other aircraft systems, or may itself be a logical subset of other aircraft systems. Thus, the controller 10 may be in logical communication with other aircraft systems and may provide the signals in response to other aircraft systems.

Embodiments without Isolation Valve

Figure 2:
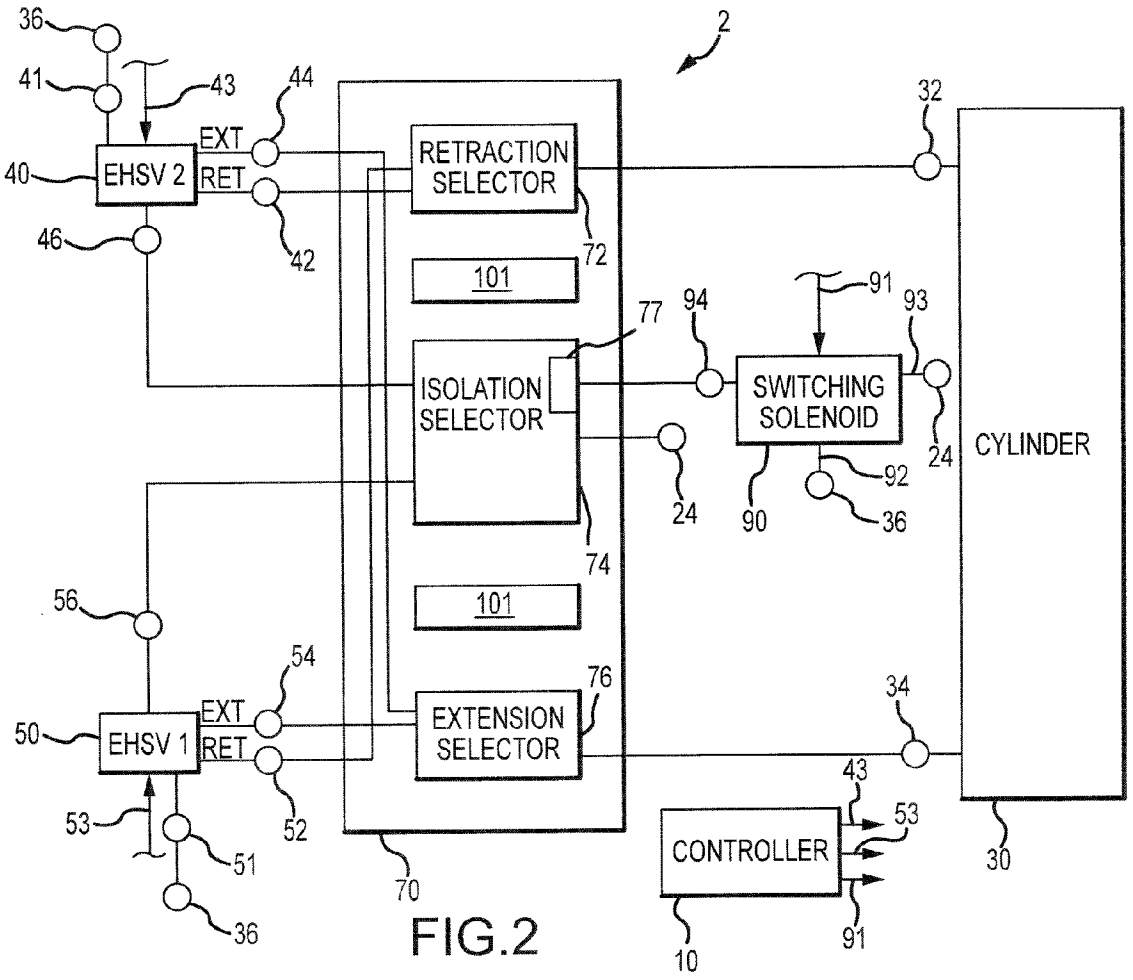
FIG. 2 illustrates a block diagram of an example actuator system without an isolation valve, in accordance with various embodiments.
Figure 5:
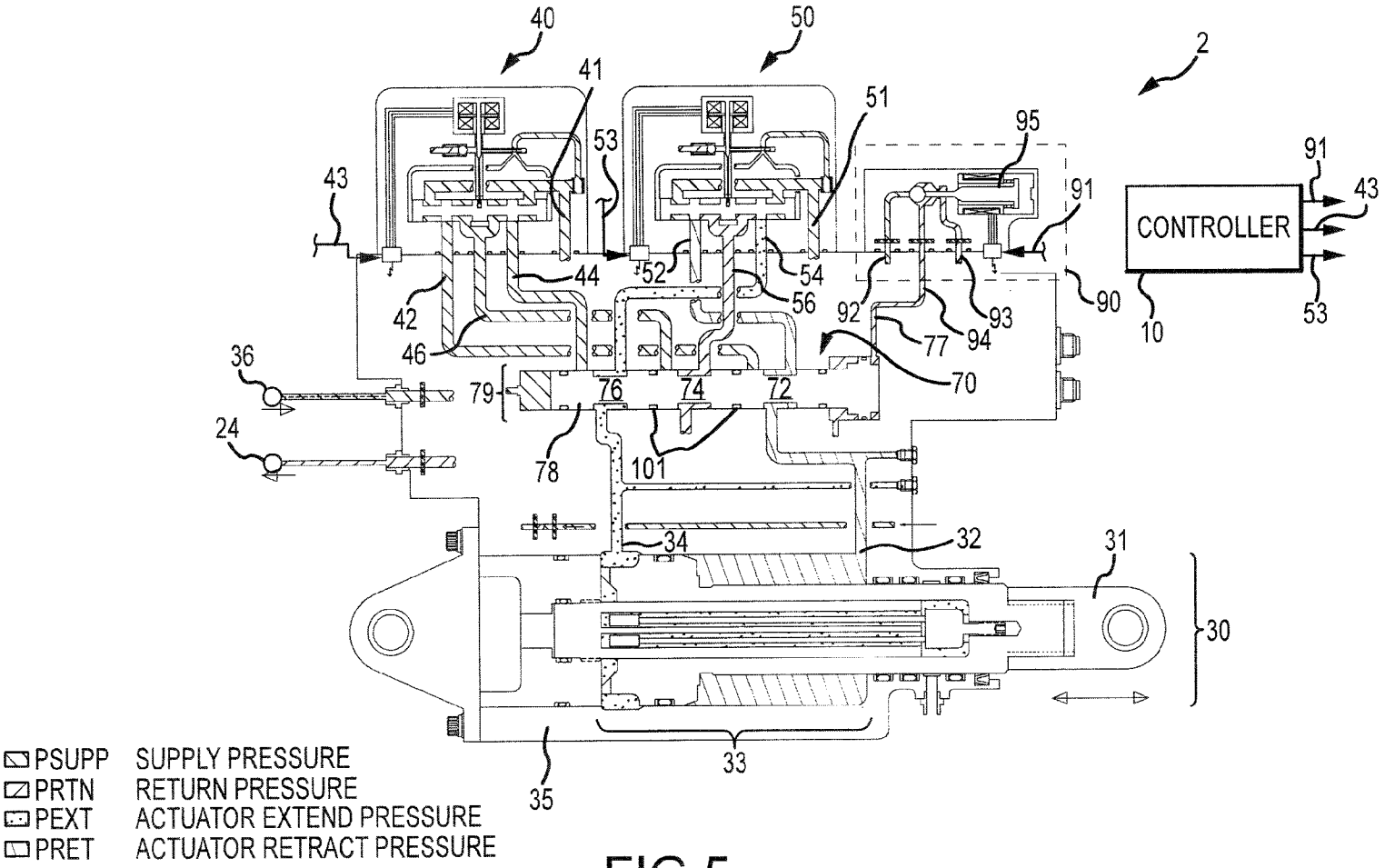
FIG. 5 illustrates an example actuator system without an isolation valve wherein the second of the dual electrohydraulic servovalves is in control, in accordance with various embodiments.
Figure 6:
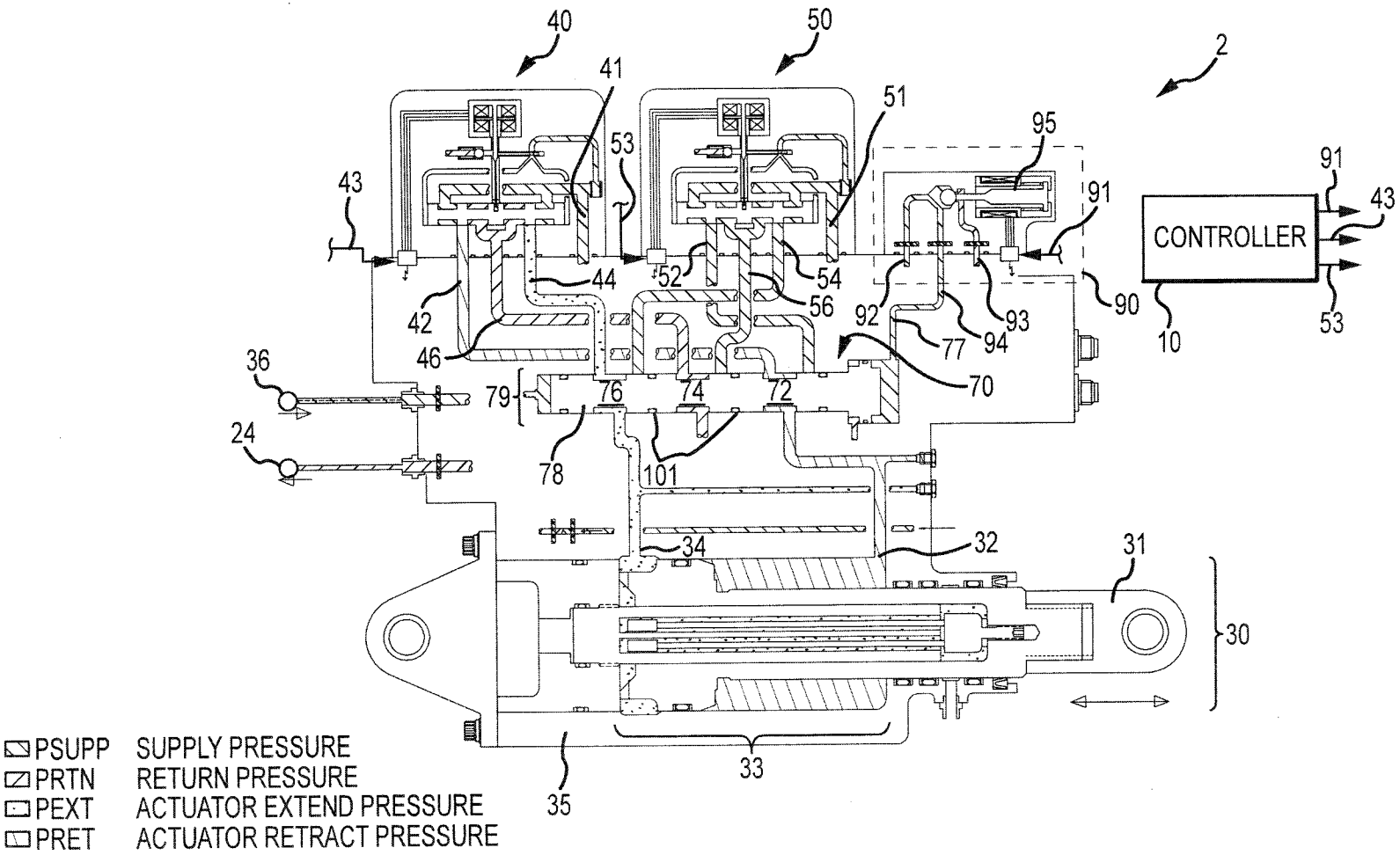
FIG. 6 illustrates an example actuator system without an isolation valve wherein the first of the dual electrohydraulic servovalves is in control, in accordance with various embodiments.
Figure 7:
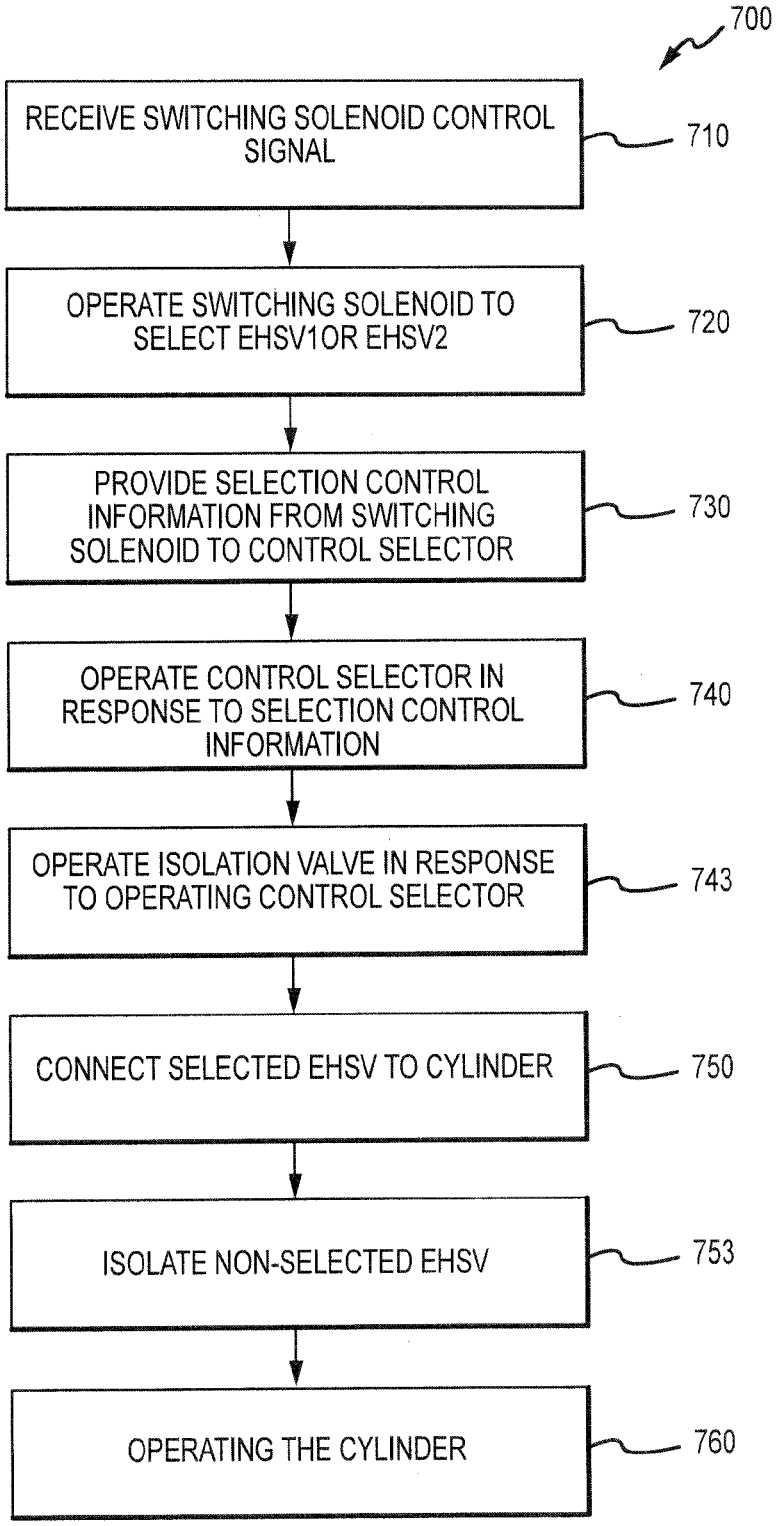
FIG. 7 illustrates a method of operating an actuator system having an isolation valve.
Figure 8:
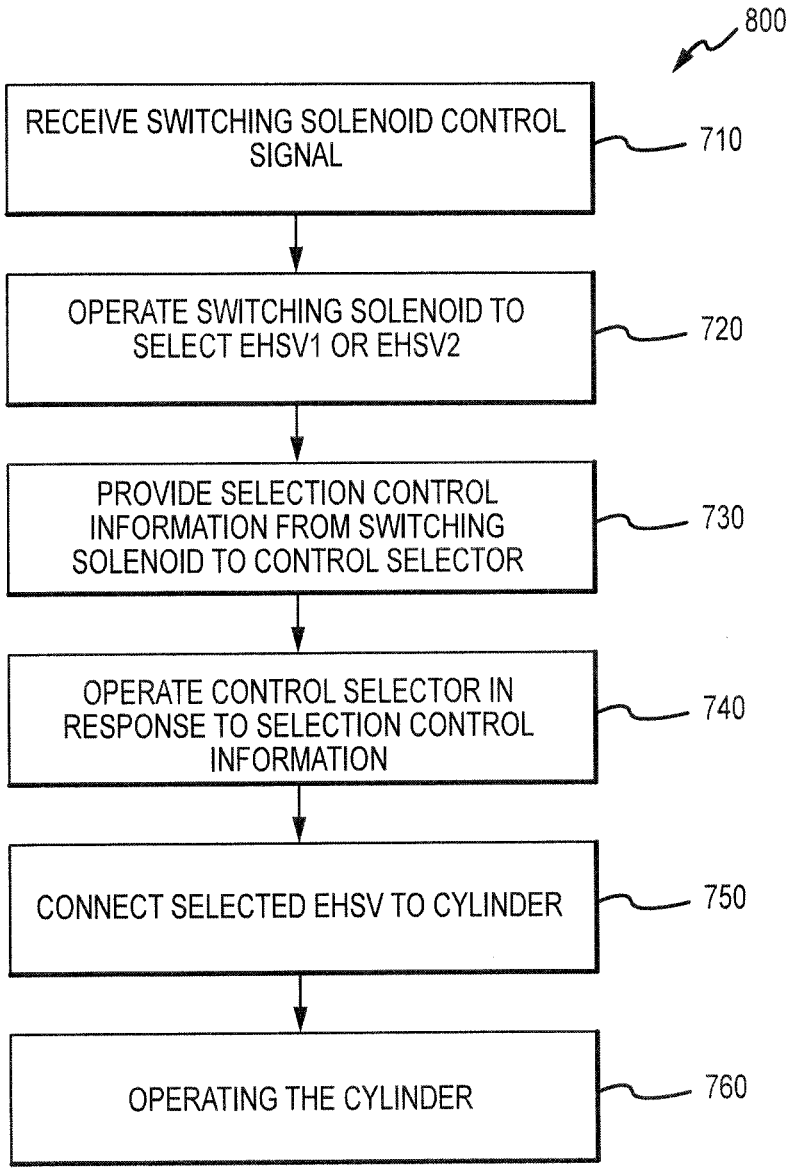
FIG. 8 illustrates a method of operating an actuator system.

Now, with reference to FIGS. 2, 5, and 6, in various embodiments, the isolation valve 60 is omitted. For example, with reference to FIGS. 2, 5, and 6, an actuator system 2 may comprise a first electrohydraulic servo valve 50 ("EHSV1"), a second electrohydraulic servo valve 40 ("EHSV2"), a control selector 70, and a switching solenoid valve 90. The actuator system 2 may direct the flow of hydraulic fluid to a cylinder 30. For example, the actuator system 2 may direct the cylinder 30 to extend and/or to retract in response to the flow of hydraulic fluid. In various embodiments, the actuator system 2 provides for redundant control of the cylinder 30. For example, the first electrohydraulic servo valve 50 and the second electrohydraulic servo valve 40 may redundantly control the cylinder 30 so that in the event that one electrohydraulic servo valve fails, the other may provide control.

The first electrohydraulic servo valve 50 may comprise a fluid valve whereby the flow of hydraulic fluid may be directed. For example, EHSV1 50 may comprise a four-port valve. EHSV1 may connect various ports in response to an EHSV1 control signal 53. The ESHV1 may comprise a first fluid supply port 51, a first fluid return port 56, a first extension port 54, and a first retraction port 52. With particular reference to FIGS. 5 and 6, the EHSV1 may alternately connect the first extension port 54 in fluidic communication with the first fluid return port 56 and/or connect the first retraction port 52 in fluidic communication with the first fluid return port 56 in response to the EHSV1 control signal 53. In response to the first fluid return port 56 being connected to the first extension port 54, the first retraction port 52 may be connected to the first fluid supply port 51, which is in fluid communication with the aircraft hydraulic supply 36. Similarly, in response to the first fluid return port 56 being connected to the first retraction port 52, the first extension port 54 may be connected to the first fluid supply port 51, which is in fluid communication with the aircraft hydraulic supply 36. Thus, high pressure fluid may transmit from the aircraft hydraulic supply 36 to the port that is isolated from the first fluid return port 56 and ultimately to the extension input 34 or retraction input 32 of cylinder 30 while the corresponding input of cylinder 30 may be connected to the first fluid return port 56 whereby fluid from the cylinder 30 may be conveyed to the aircraft hydraulic sink 24. Thus, the EHSV1 50 may control whether a cylinder 30 is extended or retracted.

Similarly, EHSV2 40 may comprise a fluid valve whereby the flow of hydraulic fluid may be directed. For example, EHSV2 40 may comprise a four-port valve. EHSV2 40 may connect various ports in response to an EHSV2 control signal 43. The ESHV2 may comprise a second fluid supply port 41, a second fluid return port 46, a second extension port 44, and a second retraction port 42. With particular reference to FIGS. 5 and 6, the EHSV2 40 may alternately connect the second extension port 44 in fluidic communication with the second fluid return port 46 and/or connect the second retraction port 42 in fluidic communication with the second fluid return port 46 in response to the EHSV2 control signal 43. In response to the second fluid return port 46 being connected to the second extension port 44, the second retraction port 42 may be connected to the second fluid supply port 41, which is in fluid communication with the aircraft hydraulic supply 36. Similarly, in response to the second fluid return port 46 being connected to the second retraction port 42, the second extension port 44 may be connected to the second fluid supply port 41, which is in fluid communication with the aircraft hydraulic supply 36. Thus, high pressure fluid may transmit from the aircraft hydraulic supply 36 to the port that is isolated from the second fluid return port 46 and ultimately to the extension input 34 or retraction input 32 of cylinder 30 while the corresponding input of cylinder 30 may be connected to the second fluid return port 46 whereby fluid from the cylinder 30 may be conveyed to the aircraft hydraulic sink 24. Thus, the EHSV2 may control whether a cylinder 30 is extended or retracted.

The control selector 70 may be disposed in fluidic communication with EHSV2 40 and EHSV1 50. The control selector 70 may also be disposed in fluidic communication with a cylinder 30. The control selector 70 may provide selective fluidic connections to the different EHSVs thus selecting which EHSV to make active and which EHSV to isolate. For example, the control selector 70 may control whether the various ports of EHSV1 50 are connected in fluid communication with the cylinder 30 and with the aircraft hydraulic sink 24 or whether instead, the various ports of EHSV2 40 are connected in fluid communication with the cylinder 30 and the aircraft hydraulic supply 36. The control selector 70 may thus control which ESHV to connect with cylinder 30 and which ESHV to isolate from the cylinder 30.

For example, the control selector 70 may fluidically connect the second retraction port 42 of EHSV2 40 to the retraction input 32 of cylinder 30 (via retraction selector 72). Alternatively, the control selector 70 may fluidically connect the first retraction port 52 of EHSV1 50 to the retraction input 32 of cylinder 30 (via retraction selector 72). Likewise, the control selector 70 may fluidically connect the second extension port 44 of EHSV2 40 to the extension input 34 of cylinder 30 (via extension selector 76). Alternatively, the control selector 70 may fluidically connect the first extension port 54 of EHSV1 50 to the extension input 34 of cylinder 30 (via extension selector 76). As discussed further herein, the control selector 70 may also alternately connect the second fluid return port 46 of EHSV2 40 or first fluid return port 56 of EHSV1 50 to aircraft hydraulic sink 24 (via isolation selector 74).

The switching solenoid valve 90 may provide the input information to operate the control selector 70 whereby the operative EHSV is selected and the isolated ESHV is selected. The switching solenoid valve 90 may receive a switching solenoid valve control signal 91. A solenoid plunger 95 may operate in response to the switching solenoid valve control signal 91 and may connect various ports in response to the switching solenoid valve control signal 91. The switching solenoid valve 90 may comprise a return input 93, a fluid supply input 92 and a selection control output 94. The switching solenoid valve 90 may alternatively connect the return input 93 with the selection control output 94 and/or connect the fluid supply input 92 with the selection control output 94. Thus, the switching solenoid valve 90 may control the control selector 70 by connecting the selection control output 94 with a relatively high hydraulic pressure (via the fluid supply input 92 connected to aircraft hydraulic supply 36) or with a relatively low hydraulic pressure (via the return input 93 connected to aircraft hydraulic sink 24). The fluid supply input 92 provides a relatively high hydraulic pressure because the fluid supply input 92 is connected, via a channel, in fluidic communication with an aircraft hydraulic supply 36. The return input 93 provides a relatively low hydraulic pressure because the return input 93 is connected, via a channel, in fluidic communication with an aircraft hydraulic sink 24.

The cylinder 30 may comprise a main body 35 and an actuator piston rod 31. The main body 35 may comprise an actuator piston cavity 33. The actuator piston rod 31 may be disposed partially within the actuator piston cavity 33 and may translate axially into and out from the actuator piston cavity 33. The cylinder 30 may also comprise a retraction input 32 and an extension input 34. The actuator piston rod 31 may translate axially out from the actuator piston cavity 33 in response to hydraulic fluid flowing into the extension input 34 and out from the retraction input 32. Similarly, the actuator piston rod 31 may translate axially into the actuator piston cavity 33 in response to hydraulic fluid flowing out of the extension input 34 and into the retraction input 32. In this manner, the actuator piston rod 31 of the cylinder 30 may be extended and/or retracted.

With reference to FIGS. 2, 5, and 6, the control selector 70 may further comprise piston 78 and a cavity 79. The piston 78 may travel within the cavity 79 in response to a selection control input 77. The control selector 70 may receive selection control information from a selection control output 94 of a switching solenoid valve 90. The selection control information may be received via a selection control input 77. In various embodiments, the selection control information comprises a hydraulic pressure, for example, a relatively high hydraulic pressure provided via fluid supply input 92 connected to aircraft hydraulic supply 36 and a relatively low hydraulic pressure provided by return input 93 connected to aircraft hydraulic sink 24. In response to the selection control information, the piston 78 travels from side to side within the cavity 79, for instance toward the selection control input 77 and away from the selection control input 77.

The piston 78 may comprise one or more seal 101, a retraction selector 72, an extension selector 76, and an isolation selector 74. In response to the piston 78 traveling from side to side within the cavity 79, for instance toward the selection control input 77 and away from the selection control input 77, the retraction selector 72, the extension selector 76, and the isolation selector 74 travel within the cavity 79 as well. In various embodiments, the retraction selector 72 comprises a circumferential land disposed about the piston 78. Similarly, the extension selector 76 may comprise a circumferential land disposed about the piston 78 and the isolation selector 74 may comprise a circumferential land disposed about the piston 78. As the piston 78 travels from side to side within the cavity 79, for instance toward the selection control input 77 and away from the selection control input 77, the extension selector 76 alternately connects the second extension port 44 of the EHSV2 40 and the first extension port 54 of the EHSV1 50 in fluidic communication with the extension input 34 of the cylinder 30. Similarly, as the piston 78 travels from side to side within the cavity 79, for instance toward the selection control input 77 and away from the selection control input 77, the retraction selector 72 alternately connects the second retraction port 42 of the EHSV2 40 and the first retraction port 52 of the EHSV1 50 in fluidic communication with the retraction input 32 of the cylinder 30. Similarly, as the piston 78 travels from side to side within the cavity 79, for instance toward the selection control input 77 and away from the selection control input 77, the isolation selector 74 alternately connects the second fluid return port 46 of EHSV2 40 and the first fluid return port 56 of EHSV1 50 to the aircraft hydraulic sink 24. In this manner, the piston 78 travels to alternately activate or seal the EHSVs depending on the position of the isolation selector 74. Similarly, the EHSVs are alternately connected to and isolated from the extension input 34 and retraction input 32 of the cylinder 30. In this manner, the control selector 70 operates in response to the switching solenoid valve 90 in order to determine the active EHSV and connect it to the cylinder 30, and to isolate the inactive EHSV from the cylinder 30.

A seal 101 may comprise a sealing member disposed annularly about the piston 78. A seal 101 may comprise rubber, although, a seal 101 may be any material adapted to ameliorate fluid leakage among retraction selector 72, extension selector 76, and isolation selector 74. Thus, a seal 101 is disposed between the retraction selector 72 and the isolation selector 74, and a seal 101 is similarly disposed between the isolation selector 74 and the extension selector 76. These seals 101 may further ameliorate leakage from the ports of the unselected EHSV. Thus, in various embodiments omitting the isolation valve 60 (isolation valve 60 shown in FIGS. 1, 3, 4), one or more seal 101 disposed about piston 78 may provide isolation (isolation valve 60 omitted and seals 101 shown in FIGS. 2, 5, 6).

A controller 10 may comprise a processor and a tangible, non-transitory memory. The controller 10 may provide various outputs to control various aspects of the actuator system 2. More specifically, the controller 10 may regulate the passage of fluid through the actuator system 2. For example, the controller 10 may control the actuator system 2 in response to a determination of an action. The controller 10 may control the actuator system 2 by providing a switching solenoid valve control signal 91 to a switching solenoid valve 90, an EHSV2 control signal 43 to the EHSV2 40, and an ESHV1 control signal 53 to the EHSV1 50. In various embodiments, the EHSV2 control signal 43 comprises an indication of whether to extend or retract the cylinder 30. Similarly, the EHSV1 control signal 53 comprises an indication of whether to extend or retract the cylinder 30.

Moreover, the switching solenoid valve control signal 91 comprises an indication of whether to select EHSV1 50 to control the cylinder 30, or to select EHSV2 40 to control the cylinder 30. Moreover, the controller 10 may comprise other aircraft systems, or may itself be a logical subset of other aircraft systems. Thus, the controller 10 may be in logical communication with other aircraft systems and may provide the signals in response to other aircraft systems.

Method of Operation

With reference to FIGS. 1, 3, 4, and 7, a method 700 of operating an actuator system 2 is provided. In various embodiments, the switching solenoid valve 90 may receive a switching solenoid valve control signal 91 (Step 710). The solenoid plunger 95 may connect the fluid supply input 92 or the return input 93 in fluidic communication with the selection control output 94 in response to the switching solenoid valve control signal 91. Thus, it may be said that the switching solenoid valve 90 is operated to select EHSV1 50 or EHSV2 40 (Step 720). The switching solenoid valve 90 may then provide selection control information, for example, a fluidic pressure, from the switching solenoid valve 90 to the control selector 70. In various embodiments, this fluidic pressure is communicated from the selection control output 94 of the switching solenoid valve 90 to the selection control input 77 of the control selector 70 (Step 730). In response to this switching control information, the control selector 70 may be operated (Step 740). For instance, the piston 78 may translate within the cavity 79 in response to the fluidic pressure.

This may align the isolation selector 74 with fluidic channels corresponding in fluidic communication with the EHSV1-Active/EHSV2-Sealed Control Port 63 or the EHSV2-Active/EHSV1-Sealed Control Port 65 of the isolation valve 60. As a result, fluid pressure may be transmitted from the aircraft hydraulic supply 36 through the isolation selector 74 and to one of the EHSV1-Active/EHSV2-Sealed Control Port 63 or the EHSV2-Active/EHSV1-Sealed Control Port 65 of the isolation valve 60. Thus, the piston 61 may translate between the first cavity portion 69 and the second cavity portion 66 of the isolation valve 60. Thus, the isolation valve 60 may be said to operate in response to operating the control selector 70 (Step 743). In response to the piston 61 translating, the first face seal 62 or the second face seal 64 may fluidically isolate the non-selected EHSV, such as by disconnecting the fluid return port of the non-selected EHSV from the aircraft hydraulic sink 24 (Step 753).

The translating of piston 78 within the cavity 79 in response to the fluidic pressure may also align the extension selector 76 and the retraction selector 72 with fluidic channels corresponding in fluidic communication with the first retraction port 52, and first extension port 54 of EHSV1 50, or alternatively, with the second retraction port 42 and second extension port 44 of EHSV2 40. Thus, the control selector 70 may connect the selected EHSV to the cylinder 30 (Step 750). Subsequently, the selected EHSV may control the cylinder 30, directing the actuator piston rod 31 to axially extend or retract with respect to the actuator piston cavity 33 (Step 760).

With reference to FIGS. 2, 5, 6, and 8, a method 800 of operating an actuator system 2 may comprise various steps. In various embodiments, the switching solenoid valve 90 may receive a switching solenoid valve control signal 91 (Step 710). The solenoid plunger 95 may connect the fluid supply input 92 or the return input 93 in fluidic communication with the selection control output 94 in response to the switching solenoid valve control signal 91. Thus, it may be said that the switching solenoid valve 90 is operated to select EHSV1 50 or EHSV2 40 (Step 720). The switching solenoid valve 90 may then provide selection control information, for example, a fluidic pressure, from the switching solenoid valve 90 to the control selector 70. In various embodiments, this fluidic pressure is communicated from the selection control output 94 of the switching solenoid valve 90 to the selection control input 77 of the control selector 70 (Step 730). In response to this switching control information, the control selector 70 may be operated (Step 740). For instance, the piston 78 may translate within the cavity 79 in response to the fluidic pressure. This may align the isolation selector 74, the extension selector 76 and the retraction selector 72 with fluidic channels corresponding in fluidic communication with the first retraction port 52, first extension port 54, and first fluid return port 56 of EHSV1 50, or alternatively, with the second retraction port 42, second extension port 44, and second fluid return port 46 of EHSV2 40. Thus, the control selector 70 may connect the selected EHSV to the cylinder 30 (Step 750). Subsequently, the selected EHSV may control the cylinder 30, directing the actuator piston rod 31 to axially extend or retract with respect to the actuator piston cavity 33 (Step 760).

Materials

Having discussed various aspects of an actuator system 2, an actuator system 2 may be made of many different materials or combinations of materials. For example, various components of the system may be made from metal. For example, various aspects of an actuator system 2 may comprise metal, such as titanium, aluminum, steel, or stainless steel, though it may alternatively comprise numerous other materials configured to provide support, such as, for example, composite, ceramic, plastics, polymers, alloys, glass, binder, epoxy, polyester, acrylic, or any material or combination of materials having desired material properties, such as heat tolerance, strength, stiffness, or weight. In various embodiments, various portions of an actuator system 2 as disclosed herein are made of different materials or combinations of materials, and/or may comprise coatings.

In various embodiments, an actuator system 2 may comprise multiple materials, or any material configuration suitable to enhance or reinforce the resiliency and/or support of the system when subjected to wear in an aircraft operating environment or to satisfy other desired electromagnetic, chemical, physical, or material properties, for example radar signature, heat generation, efficiency, electrical output, strength, or heat tolerance.

In various embodiments, various components may comprise an austenitic nickel-chromium-based alloy such as Inconel®, which is available from Special Metals Corporation of New Hartford, N.Y., USA. In various embodiments, various components may comprise ceramic matrix composite (CMC). Moreover, various aspects may comprise refractory metal, for example, an alloy of titanium, for example titanium-zirconium-molybdenum (TZM).

The hydraulic fluid may comprise any hydraulic oil or fluid. In various embodiments, however, the hydraulic fluid comprises fuel. Similarly, the aircraft hydraulic supply 36 may comprise an engine fuel supply. The fuel may be a kerosene-type jet fuel such as Jet A, Jet A-1, JP-5, and/or JP-8. Alternatively, the fuel may be a wide-cut or naphtha-type jet fuel, such as Jet B and/or JP4. Furthermore, the fuel may be a synthetic fuel, such as Fischer-Tropsch Synthetic Paraffinic Kerosene (FT-SPK) fuel, or Bio-Derived Synthetic Paraffinic Kerosene (Bio-SPK), or may be any other suitable fuel, for example, gasoline or diesel.

While the systems described herein have been described in the context of aircraft applications; however, one will appreciate in light of the present disclosure, that the systems described herein may be used in various other applications, for example, different vehicles, such as cars, trucks, busses, trains, boats, and submersible vehicles, space vehicles including manned and unmanned orbital and sub-orbital vehicles, or any other vehicle or device, or in connection with industrial processes, or propulsion systems, or any other system or process having need for actuators.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An actuator system comprising:

a first electrohydraulic servo valve comprising a four-port valve comprising a first fluid supply port, a first fluid return port, a first extension port, and a first retraction port, wherein one of the first retraction port and the first extension port is connectable to the first fluid supply port in response to a first electrohydraulic servo valve control signal, and wherein another of the first retraction port and the first extension port is connectable to the first fluid return port in response to the first electrohydraulic servo valve control signal;

a second electrohydraulic servo valve comprising a four-port valve comprising a second fluid supply port, a second fluid return port, a second extension port, and a second retraction port, wherein one of the second retraction port and the second extension port is connectable to the second fluid supply port in response to a second electrohydraulic servo valve control signal, and the other of the second retraction port and the second extension port is connectable to the second fluid return port in response to the second electrohydraulic servo valve control signal;

wherein the first fluid supply port and the second fluid supply port are in fluid communication with a hydraulic supply;

a switching solenoid valve comprising a return input, a fluid supply input, a selection control output, and a solenoid plunger, wherein the solenoid plunger connects one of the return input and the fluid supply input to the selection control output in response to a switching solenoid valve control signal;

a control selector whereby one of the first electrical hydraulic servo valve and the second electrohydraulic servo valve is connected to a cylinder in response to the switching solenoid valve connecting one of the return input and the fluid supply input to the selection control output, wherein the control selector comprises:

a cavity; and a piston disposed within the cavity and comprising:

a retraction selector;

an extension selector; and an isolation selector, wherein the piston is movable within the cavity, whereby the first extension port and the second extension port are alternately connected to the extension selector, whereby the first retraction port and the second retraction port are alternately connected to the retraction selector, and whereby the first fluid return port and the second fluid return port are alternately connected to the isolation selector.

2. The actuator system of claim 1, wherein the fluid supply input is in fluid communication with an aircraft hydraulic source.

3. The actuator system of claim 1, wherein the return input is in fluid communication with an aircraft hydraulic sink.

4. The actuator system according to claim 1, wherein the hydraulic fluid comprises fuel.

5. The actuator system according to claim 1, wherein the isolation selector is in fluidic communication with an aircraft hydraulic source.

6. The actuator system according to claim 1, wherein the control selector further comprises:

a seal disposed annularly about the piston between the retraction selector and the isolation selector;

a seal disposed annularly about the piston between the isolation selector and the extension selector.

7. The actuator system according to claim 1, further comprising:

an isolation valve in fluid communication with the first fluid return port and the second fluid return port, whereby the first fluid return port is fluidically isolated from an aircraft hydraulic sink in response to the second electrohydraulic servo valve being connected to the cylinder, and whereby the second fluid return port is fluidically isolated from the aircraft hydraulic sink in response to the first electrohydraulic servo valve being connected to the cylinder.

8. The actuator system according to claim 7, wherein the control selector comprises:

a cavity; and a piston disposed within the cavity and comprising:

a retraction selector;

an extension selector; and an isolation selector, wherein the piston is movable within the cavity, whereby the first extension port and the second extension port are alternately connected to the extension selector, whereby the first retraction port and the second retraction port are alternately connected to the retraction selector, whereby the first fluid return port and the second fluid return port are alternately connected to the isolation selector, and wherein the isolation selector is in fluidic communication with an aircraft hydraulic sink.

9. The actuator system according to claim 7, wherein the isolation valve comprises:

a first cavity portion;

a second cavity portion;

a piston comprising a first face seal and a second face seal;

wherein the piston is movable within the first cavity portion and the second cavity portion and alternately occupies the first cavity portion and the second cavity portion;

wherein the first face seal fluidically isolates a channel in fluid communication with the first fluid return port in response to the piston occupying the first cavity portion;

wherein the second face seal fluidically isolates a channel in fluid communication with the second fluid return port in response to the piston occupying the second cavity portion.

10. The actuator system of claim 9, wherein the cylinder comprises:

a retraction input in fluidic communication with the retraction selector; and an extension input in fluidic communication with the extension selector.

11. The actuator system according to claim 10, wherein the cylinder further comprises:

a main body comprising an actuator piston cavity; and an actuator piston rod disposed partially within the actuator piston cavity, wherein the actuator rod is translatable axially into the actuator piston cavity in response to hydraulic fluid at least one of flowing into the extension input or out of the retraction input, and wherein the actuator rod is translatable axially out of the actuator piston cavity in response to hydraulic fluid at least one of flowing into the retraction input or out of the extension input.

12. A method of actuator system control comprising:

receiving, by a switching solenoid valve, a switching solenoid valve control signal;

operating the switching solenoid valve to select a selected electrohydraulic servo valve in response to the switching solenoid valve control signal, wherein the selected electrohydraulic servo valve comprises one of:

a first electrohydraulic servo valve; and a second electrohydraulic servo valve;

providing, by the switching solenoid valve, selection control information to a control selector;

operating the control selector in response to the selection control information;

connecting the selected electrohydraulic servo valve to a cylinder in response to the operating the control selector; and operating an isolation valve in response to the operating the control selector; and isolating an isolated electrohydraulic servo valve, wherein the isolated electrohydraulic servo valve comprises the one of the first electrohydraulic servo valve and the second electrohydraulic servo valve that is not the selected electrohydraulic servo valve.

13. A method of actuator system control according to claim 12, further comprising:

operating the cylinder by the selected electrohydraulic servo valve, wherein the cylinder comprises an actuator piston rod disposed partially within an actuator piston cavity, wherein the operating comprises at least one of extending and retracting the actuator piston rod axially with respect to the actuator piston cavity.

* * * * *